United States Patent [19]

Kasuga

[11] Patent Number: 4,653,394

[45] Date of Patent: Mar. 31, 1987

[54] BAND FEEDING AND TIGHTENING APPARATUS AND METHOD OF FEEDING AND TIGHTENING A BAND

[75] Inventor: Yoshiaki Kasuga, Yokohama, Japan

[73] Assignee: Nichiro Kogyo Company, Ltd., Yokohama, Japan

[21] Appl. No.: 759,312

[22] Filed: Jul. 26, 1985

[30] Foreign Application Priority Data

Dec. 28, 1984 [JP] Japan ..... 59-279331

[51] Int. Cl.[4] ..... B65B 13/02

[52] U.S. Cl. ..... 100/2; 100/32

[58] Field of Search ..... 100/1, 2, 26, 29, 32

[56] References Cited

U.S. PATENT DOCUMENTS

| | | | |
|---|---|---|---|
| 3,420,158 | 1/1969 | Kobiella | 100/32 X |
| 4,161,910 | 7/1979 | Leslie | 100/32 X |
| 4,218,969 | 8/1980 | Kasuga | 100/32 |

*Primary Examiner*—Billy J. Wilhite

*Attorney, Agent, or Firm*—Oblon, Fisher, Spivak, McClelland & Maier

[57] ABSTRACT

A band feeding and tightening apparatus for a band strapping machine comprises a main shaft rotatably placed at a lateral position of a serial connection of a motor and a reduction gear device; a high speed revolution transmitting means to transmit a rotational force at the high speed side of the reduction gear device to the main shaft; a low speed revolution transmitting means to transmit a rotational force at the low speed side of the reduction gear to the main shaft through an electromagnetic clutch; a stationary shaft placed in parallel to the main shaft, the stationary shaft rotatably supporting a feed roller and a power transmitting means to transmit a rotational force of the high speed revolution transmitting mean to the feed roller through a friction clutch; and the return roller mounted on the main shaft through a one-way clutch.

4 Claims, 3 Drawing Figures

BAND FEEDING AND TIGHTENING APPARATUS AND METHOD OF FEEDING AND TIGHTENING A BAND

The present invention relates to a band strapping machine. More particularly, it relates to a method and an apparatus for feeding and tightening a band for a band strapping machine.

There has been known a band strapping machine of a type where a feed roller and a return roller which are in contact with each other are used and the feed roller is subjected to normal or reverse revolution to perform operations of feeding a band into the machine, of rapidly returning the band and of strongly tightening the band. The normal or reverse revolution of the feed roller and the return roller is carried out by causing a motor to rotate in the normal direction or the reverse direction. A reduction gear device is provided between the feed roller and the return roller to feed, return and tighten the band. In order to strongly tighten the band after the band has rapidly been returned, it is necessary to rapidly change from a low torque and high speed mode to a high torque, low speed mode each part having large mass such as a main shaft, the return roller fixed to the main shaft, a friction clutch provided between the return roller, the reduction gear device and the armature of an electromagnetic brake. Since each of these parts has large inertia, there takes place a shock at the time of completion of rapidly returning the band, whereby when a solid article such as a wooden box is packaged, fairly large noise is generated due to the shock, or when a carton box is packaged, it is sometimes broken.

Further, when a solid article such as a wooden box is packaged by a band having small elongation, there takes place slight slippage of the return roller due to the large inertia of parts fixed to the main shaft which is driven through a friction clutch, at the time of completion of rapid returning of the band. The slippage of the return roller accelerates wearing of the roller and this necessitates frequent replacement of the worn return roller.

The inventor of the present invention has noted that a shock produced by changing operations from the primary tightening to the secondary tightening can not be avoided because the operations are carried out in a single power transmission system, and the shock can be eliminated by separating the operations into two systems, i.e. the primary band tightening for one system and the secondary band tightening system for the other system.

It is an object of the present invention to reduce a shock given to parts of a band strapping machine when a band wound around a package is subjected to the primary tightening operation, followed by the secondary tightening operation and to increase efficiency of packaging for the band strapping machine.

One aspect of the present invention is to provide a band feeding and tightening apparatus for a band strapping machine comprising a reversively driven type motor, a reduction gear device connected to the motor, a feed roller and a return roller to feed and pull a band in association with the feed roller, characterized by comprising a main shaft rotatably placed at a lateral side of a serial connection of the motor and the reduction gear device; a high speed revolution transmitting means to transmit a rotational force at the high speed side of the reduction gear device to the main shaft; a low speed revolution transmitting means to transmit a rotational force at the low speed side of the reduction gear to the main shaft through an electromagnetic clutch; a stationary shaft placed in parallel to the main shaft, the stationary shaft rotatably supporting the feed roller and a power transmitting means to transmit a rotational force of the high speed revolution transmitting mean to the feed roller through a friction disk; and the return roller mounted on the main shaft through a one-way clutch.

Another aspect of the present invention is to provide a method of feeding and tightening a band for a band strapping machine comprising feeding forwardly a band through a feed roller and a return roller which are in contact with each other by transmitting a rotational force of a reversively driven type motor to the feed roller and tightening the band by reversely driving the motor to cause reverse revolution of the feed roller, characterized by imparting to the feed roller a revolution of a high speed and a low torque to perform a primary tightening operation to the band; transmitting a revolution of a low speed and a high torque taken from the output side of a reduction gear device to a main shaft on which the return roller is mounted; and transmitting a revolution of a low speed and a high torque of the main shaft to the return roller by bringing the return roller into engagement with the main shaft to perform a secondary tightening operation, when said band is wound around a package and the revolution of the return roller is reduced to the revolution of the main shaft.

An embodiment of the present invention will be described with reference to drawing.

Figure 1:
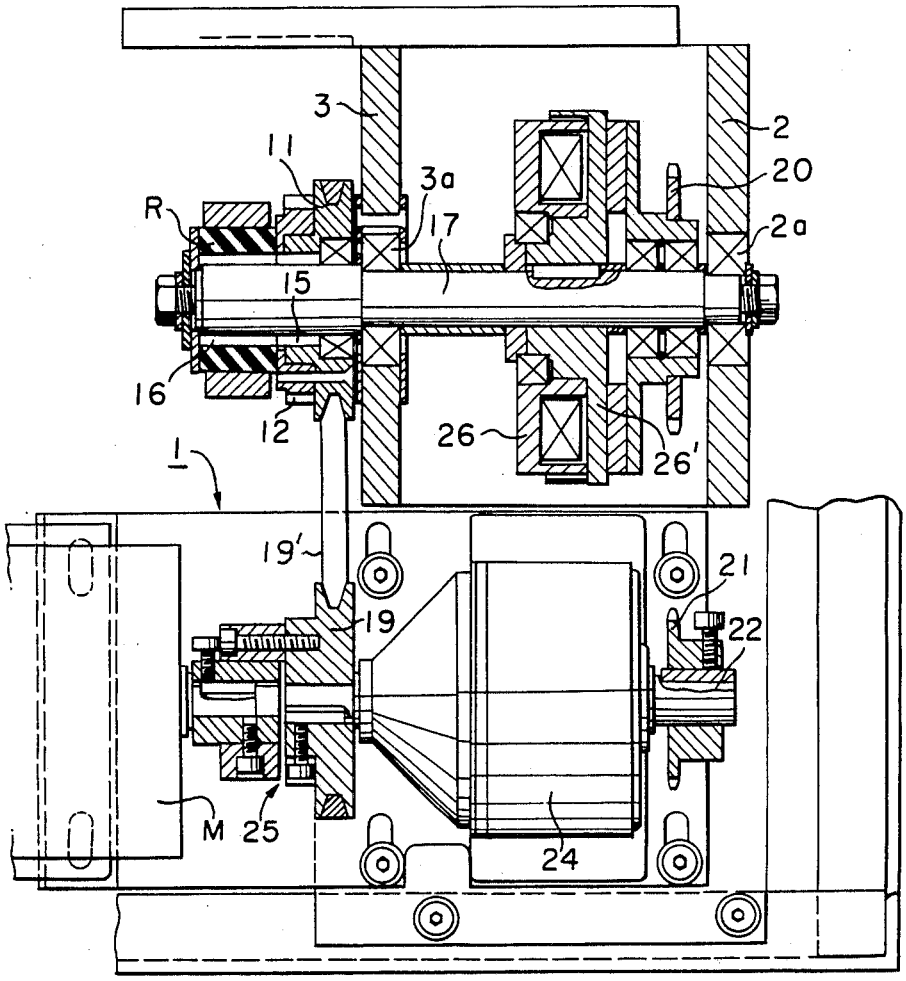
FIG. 1 is a front view partly sectioned of an embodiment of the important part of the band strapping machine according to the present invention.
Figure 3:
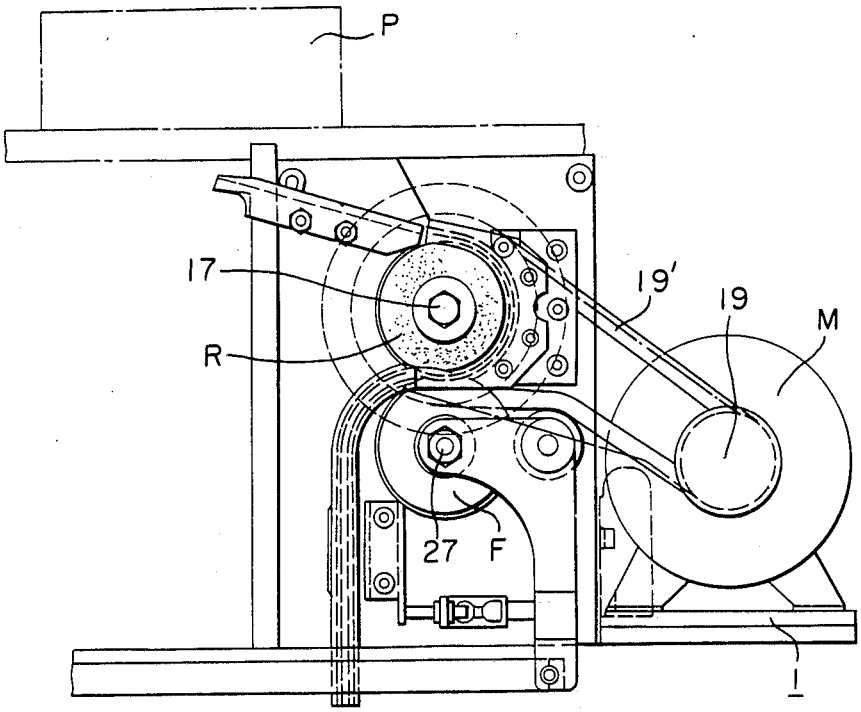
FIG. 3 is an elevation view partly omitted of an embodiment of the present invention.

In FIGS. 1 and 3, an output shaft of a motor M fixed on a base plate 1 is attached with a high speed side coupling 25 through which a reduction gear device 24 is connected to the motor M. The reduction gear device 24 is also mounted on the same base plate. A driving pulley 19 is integrally formed in or secured to the coupling 25. The reduction gear device 24 is provided with a low speed output shaft 22 to which a sprocket 21 is fitted.

A main shaft 17 is rotatably supported by a pair of brackets 2, 3 through the respective bearings *2a, 3a* at a lateral side of the reduction gear device 24. The main shaft 17 has a part outwardly extending from the bracket 3 and a pulley 11 is fitted to the extending part of the main shaft 17 through a one-way clutch 15 at a position adjacent the bracket 3. Between the brackets 2, 3, an electromagnetic clutch 26 is provided on the main shaft 17 and a sprocket 20 is provided at the side of an armature 26' of the electromagnetic clutch 26.

A V-belt 19' is extended between the driving pulley 19, which is provided between the motor M and the reduction gear device 24, and the pulley 11 attached to the main shaft 17 to thereby transmit the revolution of the motor M to the pulley 11 of the main shaft 17.

A chain (not shown) is extended between a sprocket 21 provided on the output shaft 22 of the reduction gear device 24 and the sprocket 20 of the main shaft 17 so that a rotational force of the output shaft 22 rotating at a low speed is transmitted to the main shaft 17 through the electromagnetic clutch 26. Accordingly, the main shaft 17 is rotated at a low speed by the motor M, whereby the revolution of a high torque and a low speed is transmitted to the shaft. A return roller R is fixed through a one-way clutch 16 to the main shaft 17 at a position adjacent the pulley 11. The one-way clutch 16 is so constructed that it becomes free from the main shaft 17 when the main shaft is normally rotated and it is brought into engagement with the main shaft 17 when the main shaft is reversely rotated.

Figure 2:
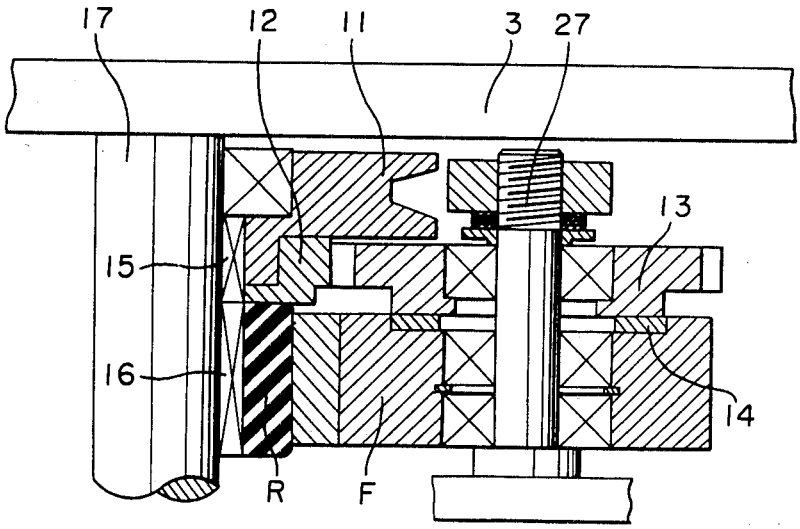
FIG. 2 is an enlarged cross-sectional view of a main shaft and associated parts of the main shaft according to an embodiment of the present invention.

In FIG. 2, a stationary shaft 27 is provided in parallel to the main shaft 17. A gear wheel 13 and a feed roller F are supported by the stationary shaft 27 in a freely rotatable manner through the respective bearings. The gear wheel 13 is in frictional contact with the feed roller F through a friction disk 14. The gear wheel 13 is interlocked with a gear wheel 12 which is integrally formed in the pulley 11 and the feed roller F is placed near the return roller R so that a band put between the outer circumferential surfaces of the both rollers is fed forwardly to be wound around the package and pulled backwardly for tightening. The feed roller F has its outer circumferential surface smoother than that of the return roller R. In this embodiment, the feed roller F is made of iron and the return roller R is attached with or formed by urethan rubber.

The band feeding and tightening apparatus of the embodiment is so constructed that when the motor M is driven in one direction to feed a band, the pulley 11 on the main shaft 17 is brought into engagement with the main shaft 17 by means of the one-way clutch 15 to thereby cause the rotation of the same, while the return roller R remains free from the rotation of the main shaft.

The operation of the apparatus of the embodiment according to the present invention will be described.

When the band is to be fed forwardly, the motor M is driven in the normal direction and the electromagnetic clutch 26 is kept in an off state. Accordingly, the main shaft 17 is caused to rotate at a high speed in the normal direction by means of the one-way clutch 15 through the driving pulley 19 and the pulley 11. At this moment, no torque is transmitted to the return roller R as described before. However, the rotation of the main shaft 17 causes the rotation of the feed roller F through the pulley 11, the gear wheels 12 and 13 and by the aid of the friction disk 14. Then, the band is introduced into the machine at a high speed by the feed roller in association of the return roller which is in contact with the feed roller. The return roller is caused to rotate at a high speed during feeding of the band since it is supported by the main shaft in a freely rotatable manner at the time of band feeding operation and is in contact with the feed roller F through the band. However, it stops upon completion of the band feeding operation.

The motor rotates for a short time due to own inertia even though it is deenergized when the band feeding operation is finished, whereby the feeding roller F is also rotated. At this moment, slippage takes place between the feed roller F and the band which is at a standstill. However, there is no problem since the feed roller F has a smooth outer circumferential surface and a pressing force of the feeding roller F to the return roller R is properly adjusted.

In the next place, the motor is reversely rotated to perform a high speed primary band tightening operation and at the same time, the electromagnetic clutch 26 is actuated. In this case, the reverse revolution the return roller R is ahead of that of the main shaft 17 because the band is rapidly pulled back.

The main shaft 17 is rotated at a low speed by receiving a rotational force from the output shaft 22 of the reduction gear device 24 through the sprockets 21 and 20 and the electromagnetic clutch 26. Namely, the revolution of the main shaft is reverse revolution of a low speed and a high torque which is imparted from the output shaft 22 of the reduction gear device 24, without receiving any torque from the driving pulley 19 and the pulley 11.

In this case, the feed roller F is reversely rotated by receiving a rotational force through the pulley 11, the gear wheels 12, 13 and the friction clutch 14 as in the band feeding operation. Since the one-way clutch 15 is interposed between the pulley 11 and the main shaft 17, the pulley 11 is merely rotated on the main shaft 17 without any relation to it and therefore, the feed roller F is caused to reversely rotate at a high speed and a low torque.

The reverse rotation of the feed roller F causes the primary tightening operation of the band at a high speed and the return roller R follows to the movement of the band, whereby a band returning operation is performed at a high-speed. A detecting means is provided so that the band at the time just before it is wound around the package is detected to actuate a solenoid (not shown) so as to increase application of a pressure to the feed roller F.

When the band is wrapped around a package 9, the primary tightening operation is finished. In this case, since the return roller is made of a material having a high friction coefficient and the package is wrapped by the band about 180°, there causes no slippage between the return roller R and the band, whereby the revolution of the return roller is rapidly reduced. However, the feed roller is made of a material having a low friction coefficient and the feed roller is in linear-contact with the band. Accordingly, slippage is caused between the feed roller F and the band, whereby the revolution of the feed roller is gradually reduced while the friction clutch slips. On the other hand, the main shaft 17 is rotated at a low speed. Accordingly, when the revolution of the return roller R which has been rotated at a high speed is reduced to the revolution of the main shaft 17, the return roller R is engaged with the main shaft 17 through the one-way clutch 16. Then, the return roller R continue to rotate at a low speed, whereby the band is strongly pulled back due to the low speed, high torque revolution of the return roller R in the engagement with the electromagnetic clutch 26. When a resistance to a force for tightening the band increases, the electromagnetic clutch 26 begins to slip and the revolution of the main shaft 17 is stopped, thus, the secondary band-tightening operation is finished.

Thus, in the present invention, the band feeding and tightening operation is divided into two operations: band-feeding and primary band tightening operations which are carried out by a feed roller mounted on a stationary shaft and a secondary band tightening operation which is carried out by a return roller on a main shaft. Accordingly, the change from the primary band tightening operation with a high speed and a low torque to the secondary tightening operation with a low speed and a high torque is carried out only by means of a one-way clutch interposed between the return roller and the main shaft. The revolution of the feed roller F is gradually reduced with slippage of the friction clutch because the feed roller F is made of a material having a low friction coefficient and the feed roller is in linear-contact with the band. A shock imparted to the feed roller and other parts at the time of completion of the primary tightening operation can be largely reduced. As a result, the primary tightening operation can be quick to thereby remarkably increase efficiency of packaging.

Further, inertia of the return roller can be largely reduced in the primary tightening operation, whereby occurrence of slippage between the band and the return roller is minimized and accordingly, durability of the band is increased.

I claim:

1. A band feeding and tightening apparatus comprising:

a feed roller having a periphery formed of low friction material;

a return roller having a periphery formed of a material having a high friction characteristic and positioned for gripping a band between said feed and return rollers;

first means for driving said feed roller in two directions; and second means for driving said return roller independently of, and at a different speed than, said feed roller, whereby slippage between said band and said feed roller prevents shocks during driving of said band.

2. The apparatus of claim 1 wherein said first means for driving comprise:

a reversible motor;

a first pulley rotatably mounted on a first shaft via a first one way clutch and driven by said motor; and means for rotating said feed roller together with said first pulley.

3. The apparatus of claim 2 wherein said second means for driving comprise:

speed reduction means driven by said motor;

a second one way clutch mounting said return roller on said first shaft; and electromagnetic clutch means for selectively driving said first shaft via said speed reduction means.

4. A method for feeding and tightening a band comprising the steps of:

gripping a band between a low friction feed roller means and a high friction return roller means;

driving only said feed roller in one direction at high speed while said return roller is freely rotating to feed said band;

driving only said feed roller in an opposite direction at high speed while said return roller is freely rotating to tighten said band; and driving only said return roller in said opposite direction at low speed while said feed roller is freely rotating to further tighten said band.

* * * * *